United States Patent [19]

Hatcher

[11] 4,219,997

[45] Sep. 2, 1980

[54] SPUN-LIKE CONTINUOUS MULTIFILAMENT YARN

[75] Inventor: Charles S. Hatcher, Greenville, S.C.

[73] Assignee: Phillips Petroleum Company, Bartlesville, Okla.

[21] Appl. No.: 934,666

[22] Filed: Aug. 17, 1978

[51] Int. Cl.[2] ..... D02G 1/20; D02G 1/20

[52] U.S. Cl. ..... 57/245; 57/289; 57/290; 57/350; 57/351; 57/908

[58] Field of Search ..... 57/244–247, 57/288, 350, 3, 6, 248, 289–290, 328, 231, 351, 908; 28/247, 271

[56] References Cited

U.S. PATENT DOCUMENTS

| | | | |
|---|---|---|---|
| 3,273,328 | 9/1966 | Block | 57/245 X |
| 3,309,855 | 3/1967 | Stoll et al. | 28/271 X |
| 3,401,516 | 9/1968 | Chidgey et al. | 57/245 |
| 3,948,033 | 4/1976 | Henstock et al. | 57/908 X |
| 4,034,548 | 7/1977 | Bueb et al. | 57/288 |
| 4,038,811 | 8/1977 | Ansin et al. | 28/271 X |
| 4,060,970 | 12/1977 | Talbot | 57/247 X |
| 4,110,964 | 9/1978 | Bruner | 57/290 X |
| 4,164,117 | 8/1979 | Talbot | 57/289 |

*Primary Examiner*—Donald Watkins

[57] ABSTRACT

A process is disclosed for producing a continuous multifilament yarn of melt-spinnable, polymeric material which is essentially free from stretch and which comprises draw-texturing a first continuous filament yarn end, combining the first end with a second flat continuous filament yarn end, and feeding the combined textured and flat ends through a jet interlacer in an overfeed condition with the textured end being fed at a greater rate of overfeed than that of the flat end. An alternate process is disclosed wherein draw-texturing of the first textured yarn end and drawing of the second flat yarn end are performed simultaneously prior to jet interlacing of the overfed combined ends. Also disclosed is the spun-like continuous multifilament yarn produced by the novel process as well as resulting fabric made from the yarn.

22 Claims, 4 Drawing Figures

SPUN-LIKE CONTINUOUS MULTIFILAMENT YARN

This invention relates to the production of yarn. In one aspect it relates to a novel process for the production of continuous multifilament yarn. In another aspect it relates to a novel yarn produced by the novel process. In yet another aspect the invention relates to novel fabric made from the novel yarn.

There has been an accelerating trend toward a spun yarn look in outer wear recently, as evidenced by numerous articles in trade publications and reduced sales of continuous filament polyester. For some time, the textile industry has sought ways of producing yarns from continuous filaments such that the yarns have the characteristics of a spun yarn comprising staple fibers and can be woven into fabric having a spun yarn look. Prior to the development of synthetic filaments, all yarns were produced from staple products. Synthetic filaments, however, are manufactured in the form of continuous filaments and, in order to provide the desirable effects of staple products, a vast proportion of synthetic filament production has been cut into staple length fibers, which fibers are then twisted into yarns called spun yarns.

Spun yarns have a particularly desirable characteristic of being somewhat fuzzy along their length, giving them the desirable attributes of softness and cover and, when woven into fabrics, the ability to produce low density, porous, permeable and comfortable materials. Continuous filament yarns also have many desirable attributes but these are accompanied by limitations, particularly with respect to bulk, cover and comfort factors. It is well known, however, that continuous filament yarns have replaced spun yarns for many end uses.

It is readily apparent that, if a continuous filament yarn can be made into a spun-like yarn, the otherwise expensive steps of cutting continuous fibers into staple followed by opening, picking, carding, drawing and twisting into roving, followed by drafting and twisting further into spun yarns could be eliminated. Many attempts have been made to accomplish this feat but various limitations in the resulting products have prevented such continuous filament yarns from completely replacing spun yarns. One such limitation is that the prior art spun-like continuous multifilament yarns normally are characterized by having crimp stretch which is an undesirable characteristic in certain woven and knitted textile fabrics.

It would thus be advantageous to produce a simulated spun-like yarn made of continuous filaments which provides good bulk, cover and comfort and does not have the disadvantages of the prior art, specifically the characteristic of crimp stretch normally associated with simulated spun-like yarns.

In accordance with the present invention it has been discovered that a spun-like, continuous synthetic filament yarn essentially free from stretch, (i.e. less than 10 percent stretch without filament elongation) which can be woven, knitted or otherwise made into a fabric having a spun-like appearance, can be produced by combining a continuous multifilament draw-textured first yarn end and a flat continuous multifilament yarn end, and interlacing the draw-textured yarn end and the flat yarn end.

It is an object of the present invention to produce a textured continuous filament yarn of melt-spinnable polymer material with spun-like yarn appearance and feel.

It is another object of the present invention to produce a textured continuous filament yarn of spun-like appearance and feel which has less than 10% stretch without filament elongation.

Another object of the present invention is to provide a process for the production of a textured continuous filament yarn of melt-spinnable polymer material with spun-like yarn appearance and feel which is at least substantially free from stretch.

Yet another object of the present invention is to produce a fabric made from a spun-like continuous filament yarn which fabric exhibits a spun-like appearance.

Other aspects, objects and advantages of the invention will be evident from the following detailed description and claims when read in conjunction with the accompanying drawing in which:

More specifically, in accordance with the invention there is provided a process for producing a continuous multifilament yarn comprising draw-texturing a first continuous filament yarn end, combining the first end with a second flat continuous filament yarn end, and feeding the combined ends to a jet interlacer in an overfeed condition with the textured yarn end being fed at a greater rate of overfeed than that of the flat yarn end. A predetermined length of continuous multifilament yarn produced by this process comprises a first component yarn having at least one first draw-textured filament which is interlaced into the flat yarn end, the length of the at least one first draw textured filament being greater than the length of any filament of the flat yarn end. A fabric exhibiting a spun-like appearance and made from the continuous multifilament yarn is also provided in accordance with this invention.

Figure 1:
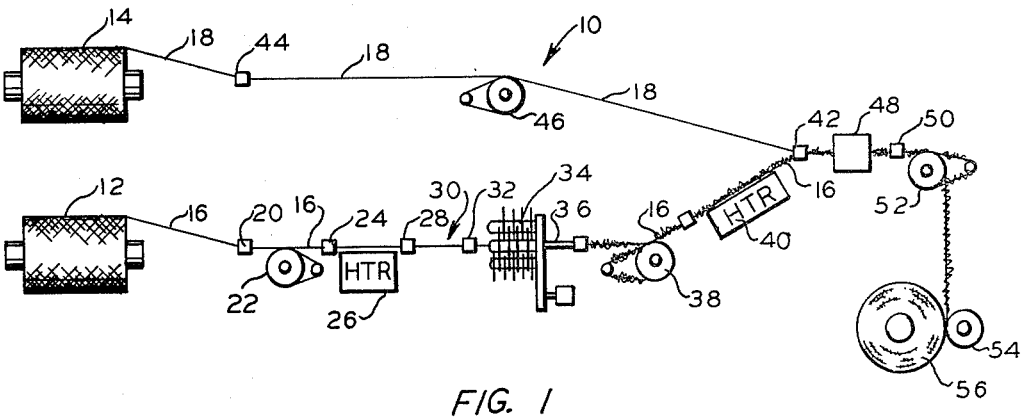
FIG. 1 is a schematic diagram illustrating the process of the present invention.

Referring now to FIG. 1, apparatus is schematically depicted therein for the production of the continuous multifilament yarn of the present invention and is generally designated by the reference character 10. It is presently preferred to employ a Scragg SDS-II draw-texturing machine as the apparatus 10. This unit is manufactured by Ernest Scragg and Sons Limited, P.O. Box 16, Sunderland Street, Macclesfield, England.

As employed in the present manufacturing process, the apparatus 10 includes a creel structure (not shown) which will simultaneously accommodate at least two yarn supply packages 12 and 14. The packages 12 and 14 supply first and second component yarn ends 16 and 18, respectively, to the apparatus 10. Yarn end 16 is directed through a suitable guide 20 to an input feed roll system 22, from the feed roll system 22 through guide 24 over a first heater 26 and thence through a guide 28 into a cooling zone 30. From the cooling zone 30, the yarn end 16 moves through a guide 32 and continues through a multi-disc friction-false-twist unit or friction aggregate 34 of the general type described and illustrated in U.S. Pat. No. 3,885,378. The presently preferred friction-twist unit is known under the registered trademark Positorq of Ernest Scragg and Sons, Limited and is well known to those skilled in the yarn friction-twisting art.

The false-twisted yarn end 16 is directed from the friction-twist unit 34 through a guide tube 36 to an intermediate feed roll or draw roll system 38. From the draw roll system 38, the friction twisted yarn end 16 passes directly through a final heater block 40 and then through a guide 42.

The yarn end 18 is directed from the package 14 through a guide 44 to an input feed roll system 46 and is directed therefrom to the guide 42 where the yarn ends 16 and 18 are combined by combining the yarn ends 16 and 18 together as they pass through the guide 42 before passing through an entanglement zone in the form of a jet entangler 48 and thence through a guide 50 into an output roll system 52. From the output roll system 52, the combined and interlaced yarn ends 16 and 18 are directed as a composite yarn to a yarn winding head 54 where the composite yarn is wound on a suitable take-up tube to form a yarn package 56.

The first and second component yarn ends 16 and 18 can be any suitable multifilament yarn ends, but are generally in the form of continuous multifilament yarns formed of a suitable melt-spinnable polymeric material. The presently preferred melt-spinnable polymeric material is polyethylene terephthalate, however it will be understood that either or both of the component yarns may be formed of other suitable melt-spinnable polymeric materials, e.g. polyesters, polyamides, polyolefins, and mixtures of any two or more thereof or the like. The first yarn end 16 is preferably a partially oriented continuous multifilament yarn of polyethylene terephthalate, while the second yarn end 18 is preferably a draw-twisted flat continuous multifilament yarn also preferably formed of polyethylene terephthalate. The term "flat" as used herein shall be understood to mean non-textured when applied to continuous multifilament yarns and the filaments thereof.

Yarns suitable for the first yarn component 16 are preferably produced at spinning speeds above about 900 meters per minute, while polyethylene terephthalate or polyester yarns suitable for the first yarn component 16 are preferably spun at at least about 2400 meters per minute. The spinning speeds of yarns suitable for the second yarn component 18 are not critical but would normally be above about 250 meters per minute. The denier of the first component yarn end 16 can be any suitable value, but is generally in the range from about 240 to about 1000. The denier of the second component yarn end 18 can be any suitable value, but is generally in the range of from about 75 to about 300. The deniers of the first and second component yarn ends 16 and 18 can be identical or can differ one from the other.

As mentioned above, the first and second component yarns can be suitably formed of a melt-spinnable polymer selected from the group consisting essentially of polyester, polyamides, polyolefins and mixtures thereof, while a presently preferred melt-spinnable polymer is polyethylene terephthalate.

The first partially oriented yarn end 16 is directed over the first heater 26 which can be maintained at any suitable temperature, but is generally maintained at a temperature of from about 140° C. to about 230° C. The heater 26 is maintained at a temperature in the range from about 210° C. to about 220° C., and preferably approximately 215° C. when draw-texturing polyester yarn. The draw ratio of the first yarn end 16 in the apparatus 10 can be any suitable value, but is generally within the range from about 1.5 to about 4. The draw ratio for polyester yarn is generally in the range from about 1.5 to about 2.0, and is preferably approximately 1.87. The draw ratio referred to herein is the ratio of the linear speed of the draw roll system 38 to the linear speed of the input feed roll system 22. The yarn speed through the draw-texturing apparatus 10 can be any suitable value, but it is presently preferred to maintain a yarn speed through the draw-texturing apparatus 10 in the range of from about 200 meters per minute to about 700 meters per minute, measured at the takeup yarn winding heat 54. When processing polyethylene terephthalate yarn, a yarn speed of approximately 224 meters per minute through the draw-texturing apparatus 10 at the takeup yarn winding head 54 provides good results. The ratio of the peripheral speed of the twisting device 34 to the yarn speed through the apparatus 10 can be any suitable value, but this ratio is generally within the range from about 1.59 to about 1.86, and is preferably approximately 1.71. The final heater block 40 can be maintained at any suitable temperature, but is generally maintained at a temperature of from about 140° C. to about 220° C.

When processing polyester yarn, the heater 40 is preferably maintained at approximately 200° C. The stabilizing overfeed of the friction-twisted, draw-textured yarn 16 in the area of the final heater block 40 can be maintained at any suitable value, but is generally maintained within the range of from about 15 percent to about 25 percent, is preferably in the range from about 19 percent to about 21 percent, and is more preferably approximately 91.7 percent. The overfeed of the draw-twisted flat yarn end 18 between the input feed roll system 46 and the output roll system 52 can be maintained at any suitable value, but is generally maintained within the range of about 1 percent to about 10 percent, and is preferably approximately 5 percent.

Figure 3:
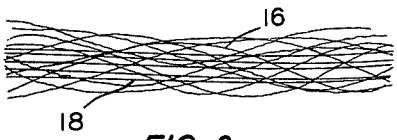
FIG. 3 is an enlarged diagrammatical illustration of a continuous multifilament yarn produced in accordance with the present invention.
Figure 4:
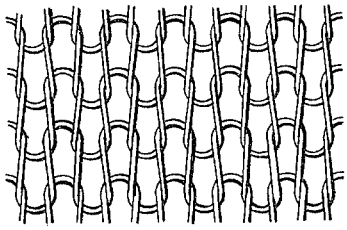
FIG. 4 is an enlarged illustration of a textile fabric produced in accordance with the present invention.

After false-twist texturing, the yarn end 16 has a maximum tendency to contract and can therefore be more highly overfed relative to the flat yarn end 18 thus creating helical forms in the filaments of the yarn end 16 which are subsequently interlaced into the flat yarn end as they pass together through the jet entangler 48, as illustrated in FIG. 3. It is considered of special significance that the final interlaced composite yarn resulting from the present process is non-stretch or "zero stretch," i.e. the composite yarn exhibits less than 10 percent stretch without filament elongation, in that the flat yarn filaments remain relatively straight and the stretch properties of the resulting composite yarn are governed by the physical properties of the flat yarn. In contrast, other spun-like filament yarns normally exhibit crimp stretch characteristics.

Entanglement of the resulting composite yarn also provides for good delivery of the yarn from its takeup package and for good weaving performance while retaining the spun-like appearance of the fabric woven therefrom. Entanglement reduces the size of slubs in the yarn, giving fabrics woven or knitted therefrom a smoother, but still spun-like appearance. This effect of entanglement reduces appearance variability among and within yarn and fabric samples.

Figure 2:
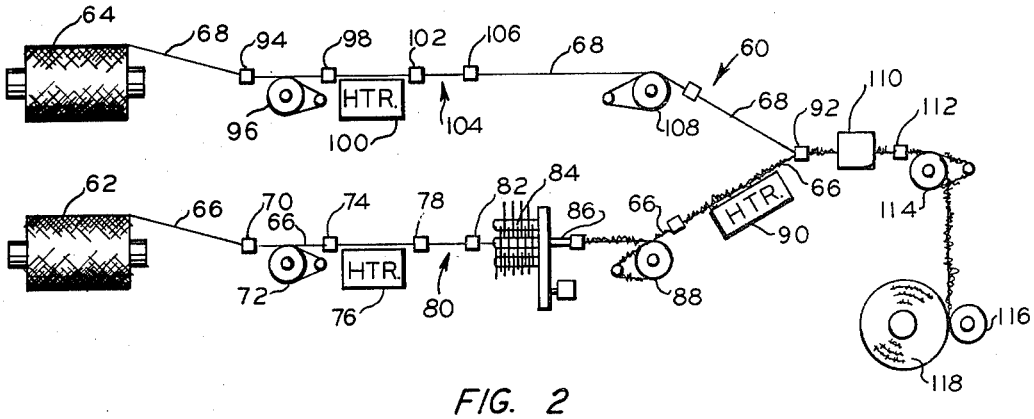
FIG. 2 is a schematic diagram illustrating an alternate form of the process of the present invention.

Referring now to FIG. 2, an alternate embodiment of the apparatus of the present invention is schematically depicted therein which is advantageously employable for the production of the continuous multifilament yarn of the present invention, and is generally designated by the reference character 60. As with the previously described apparatus 10, it is presently preferred to employ a slightly modified Scragg SDS-II draw-texturing machine as the apparatus 60.

As employed in the present manufacturing process, the apparatus 60 includes a creel structure (not shown) which will simultaneously accommodate at least two yarn supply packages 62 and 64. The packages 62 and 64 supply first and second component yarn ends 66 and 68, respectively. Yarn end 66 is directed through a suitable guide 70 to an input feed roll system 72, from the feed roll system 72 through guide 74 over a first heater assembly 76, and thence through a guide 78 into a cooling zone 80. From the cooling zone 80, the yarn end 66 moves through a guide 82 and continues through a multi-disc friction-false-twist unit or friction aggregate 84 of the general type described above for the apparatus 10 at which time the yarn end 66 is friction-false-twisted.

The thus false-twisted yarn end 66 is directed from the friction-twist unit 84 through a guide tube 86 to an intermediate feed roll or draw roll system 88. From the draw roll system 88, the friction-false-twisted yarn end 66 passes directly through a final heater block 90 and then through a guide 92.

The yarn end 68 is directed from the supply package 64 through a guide 94 to an input feed roll system 96, from the feed roll system 96 through guide 98 and over a heater 100, and thence through a guide 102 into a cooling zone 104. From the cooling zone 104, the yarn end 68 moves through a guide 106 to an intermediate feed roll or draw roll system 108 and thence through the guide 92.

As the yarn ends 66 and 68 simultaneously pass through the guide 92 they are combined together before passing through an entanglement zone in the form of a jet entangler 110 where the yarn ends are mutually interlaced and thence through a guide 112 into an output roll system 114. From the output roll system 114, the combined and mutually interlaced yarn ends 66 and 68 are directed as a composite yarn to a yarn winding head 116 where the composite yarn is wound on a suitable takeup tube to form a yarn package 118.

The first and second component yarn ends 66 and 68 can be any suitable multifilament yarn ends, but are generally in the form of continuous multifilament yarns formed of a suitable melt-spinnable polymeric material such as that described above for the yarn ends 16 and 18. The first and second yarn ends 66 and 68 are preferably supplied in the form of partially oriented continuous multifilament yarns of polyethylene terephthalate. The spinning speeds of yarns suitable for the first and second component yarn ends 66 and 68 can be of any suitable value, but generally the spinning speeds are the same as those specified for yarn ends 16 and 18 of the first described embodiment. The deniers of each of the component yarn ends 66 and 68 can be of any suitable value, but are generally in the range of from about 240 to about 1000. The deniers of each of the first and second component yarns 66 and 68 can be identical or can differ one from the other.

The first partially oriented yarn end 66 is directed over the first heater 76 which can be maintained at any suitable temperature, but is generally maintained at a temperature of from about 140° C. to about 230° C. When draw-texturing polyester yarn, the heater 76 can be maintained at any suitable value but is generally in the range from about 210° C. to about 220° C., and is preferably approximately 215° C. The draw ratio of the first yarn end 66 in the apparatus 60 can be of any suitable value, but is generally within the range of from about 1.5 to about 4, and is preferably approximately 2.0. The draw ratio referred to herein is the ratio of the linear speed of the draw roll system 88 to the linear speed of the input feed roll system 72. The ratio of the peripheral speed of the twisting device 84 to the yarn speed through the apparatus 60 can be of any suitable value, but is generally within the range of from about 1.59 to about 1.86, and is preferably approximately 1.71. The final heater block 90 can be maintained at any suitable temperature, but is generally maintained at a temperature of from about 140° C. to about 220° C. When draw-texturing polyester, the heater block 90 can be maintained at any suitable temperature, but is generally maintained at a temperature in the range from about 195° C. to about 205° C., and is preferably approximately 200° C.

The stabilizing overfeed of the friction-twisted, draw-textured yarn 66 in the area of the final heater block 90 can be of any suitable value, but the stabilizing overfeed is generally within the range of from about 10 percent to about 25 percent, is preferably in the range of about 11 percent to about 14 percent, and is more preferably approximately 12.5 percent.

The second partially oriented yarn 68 is directed over the heater 100 which can be maintained at any suitable temperature, but is generally maintained at a temperature of from about 140° C. to about 230° C. When drawing polyester yarn, the heater 100 is maintained at any suitable temperature, but the temperature is generally in the range from about 210° C. to about 220° C., and is preferably approximately 215° C. The draw ratio of the second yarn end 68 in the apparatus 60 can be any suitable value, but is generally within the range from about 1.5 to about 4, and is preferably approximately 3.5. The last mentioned draw ratio referred to is the ratio of the linear speed of the draw roll system 108 to the linear speed of the input feed roll system 96. While any suitable yarn speed through the apparatus 60 can be employed, a yarn speed in the range of about 200 meters per minute to about 700 meters per minute, and, for polyethylene terephthalate, preferably approximately 350 meters per minute through the draw-texturing apparatus 60, measured at the takeup yarn winding head 116, provides good results. The second yarn end 68 provided to the jet entangler 110 is a fully drawn flat yarn and can be provided at any suitable overfeed, but the yarn end 68 is generally provided at an overfeed between the draw roll system 108 and the output roll system 114 within the range from about 1 percent to about 10 percent, is preferably in the range from about 4 percent to about 6 percent and preferably approximately 5 percent.

It will be seen that the apparatus 60 permits the simultaneous draw-texturing of the yarn end 66 and the drawing of the drawn flat yarn end 68 immediately prior to their combination and mutual jet entanglement to form a composite non-stretch or "zero stretch" spun-like continuous multifilament yarn, i.e. a yarn having less than 10 percent stretch without filament elongation.

The following example is illustrative of a preferred embodiment of the present process.

EXAMPLE I

A first continuous multifilament 290/34 component yarn end, i.e. a yarn of 290 total denier and 34 filaments, partially oriented polyethylene terephthalate polymer was fed from a supply package at about 149 meters per minute via the input feed roll system of a Scragg SDS-II friction-texturing machine using a Scragg Positorq friction-twist unit over a primary heater at a temperature of about 215° C. and then through a cooling zone to said friction-twist unit. The draw-textured first component yarn end was withdrawn from the friction-twist unit at about 279 meters per minute by a draw roll system and was directed therefrom through a final heater at a temperature of about 200° C. and then through a jet entangler to an output roll system operating at about 224 meters per minute. The jet entangler was provided with a yarn passage bore of 0.625 in. (15.9 mm.) in length with a diameter of 0.156 in. (3.96 mm.). The bore was intersected by two air jet passages perpendicular to the bore with a 60° angle therebetween. Each air jet passage had a diameter of 0.062 in. (1.57 mm.) and a length of 0.118 in. (3.0 mm.) Simultaneously, a second continuous multifilament 145/34 component yarn end, i.e. a yarn of 145 total denier and 34 filaments, of draw-twisted flat polyethylene terephthalate was fed from a supply package by an input feed roll system of a separate roll stand at about 236 meters per minute directly through the jet entangler, where the first and second yarn ends were combined by passing the first and second yarn ends together through a common guide and jet entangled. The thus combined and entangled or interlaced resulting final composite yarn was withdrawn from the jet entangler by an output roll system at about 224 meters per minute and was then wound on a takeup tube to form a yarn package. The formation of the resulting final composite yarn was achieved under the following conditions:

Friction-twist unit employed: Scragg Positorq® with 12 disc ceramic friction-twisters and 35.5 millimeter center spacing;

Throughput speed (measured at output roll system): 224±5 meters per minute;

D/Y ratio (peripheral speed of friction discs to linear yarn speed): about 1.71;

Let-back of first yarn end between draw roll system and output roll system: about 19.7 percent;

Overfeed of flat second yarn end between second yarn end input feed roll system and output roll system: about 5 percent;

Draw ratio (ratio of draw roll system linear speed to input feed roll system linear speed for first yarn end): about 1.87;

Entangling: air jet entangler at 65 psig air pressure;

Minimum tension on second flat yarn end through jet entangler: about 5 grams;

Tension on first yarn end immediately preceding passage through friction-twist unit: about 40 grams;

Tension on first yarn end immediately after passage through friction-twist unit: about 42 grams; and Winder tension: 100±10 grams.

The composite final yarn was 310/68, i.e. 310 total denier and 68 filaments. The final yarn was quite spun-like in appearance. The yarn had less than 10 percent stretch without filament elongation, but was loopy and hairy similar to spun yarn. The stretch of the final yarn was substantially less than the stretch of conventional textured yarns which generally exhibit more than 12 percent stretch without filament elongation. The final yarn was knitted into a knit sleeve which had very desirable hand compared to similar articles knitted from conventional textured yarns. The final yarn was also woven as filling and weaving performance was good without further treatment such as twisting, slashing, etc.

The following calculated example is illustrative of the alternate embodiment of the present process.

EXAMPLE II

A first continuous multifilament 350/34 component yarn end, partially oriented polyethylene terephthalate polymer is fed from a supply package at about 200 meters per minute by the input feed roll system at a first position of a Scragg SDS-II friction-texturing machine using a Scragg Positorq friction-twist unit over a primary heater at a temperature of about 215° C. and then through a cooling zone to said friction-twist unit. The draw-textured first component yarn end is withdrawn from the friction-twist unit at about 400 meters per minute by a draw roll system and is directed therefrom through a final heater at a temperature of about 200° C. and then through a jet entangler and output roll system operating at about 350 meters per minute. The jet entangler has a yarn passage bore 0.625 in. (15.9 mm) long and 0.156 in. (3.96 mm.) in diameter. The bore is intersected by two air jet passages perpendicular to the bore with a 60° angle therebetween. Each air jet passage has a diameter of 0.062 in. (1.57 mm.) and a length of 0.118 in. (3.0 mm.). Simultaneously, a second continuous multifilament 350/34 component yarn end of partially oriented polyethylene terephthalate polymer is fed from a supply package at about 100 meters per minute by the input feed roll system at a second position of said Scragg SDS-II friction-texturing machine, adjacent the first position of the first component yarn end, over a primary heater at a temperature of about 215° C. and then through a cooling zone to a draw roll system at the second position at about 368 meters per minute. The resulting drawn, flat second component yarn end is directed from the draw roll system through said jet entangler where the first and second component yarn ends are combined and interlaced, and then the combined and entangled resulting final composite yarn is withdrawn by said output roll system at about 350 meters per minute and is subsequently wound on a takeup tube to form a yarn package. The formation of the resulting final composite yarn is achieved under the following conditions:

Friction-twist unit employed on first yarn end: Scragg Positorq® with 12 disc ceramic friction-twisters and 35.5 millimeter center spacing;

Throughput speed (measured at the output roll system): 350±5 meters per minute;

D/Y ratio (peripheral speed of friction discs to linear yarn speed): about 1.71;

Let-back of draw-textured first yarn end between first draw roll system and output roll system: about 12.5 percent;

Let-back of flat second yarn end between second draw roll system and output roll system: about 5 percent;

Draw ratio of draw-textured first yarn end (draw roll speed to feed roll speed): about 2.0;

Draw ratio of flat second yarn end (draw roll speed to feed roll speed): about 3.5; and Entangling: air jet entangler at 65 psig air pressure.

The composite final yarn is 300/68, i.e. 300 total denier and 68 filaments.

While the examples illustrate the utilization of the present process with polyethylene terephthalate yarns, it is recognized that other thermoplastic, friction-false-twist texturable yarns can also be used with corresponding good results. Such yarns can be used in combination with polyethylene terephthalate or in other combinations.

It will also be understood various textile fabrics comprising a plurality of yarns can be knitted, woven or otherwise suitably formed employing a continuous multifilament yarn produced in accordance with the invention. Such a textile fabric can include at least one yarn produced in accordance with the invention in combination with one or more other yarns, or each of the yarns of such textile fabric can be a yarn produced in accordance with the invention.

While the invention has been described more particularly with reference to the preferred embodiments, it is recognized that various changes can be made without departing from the spirit and scope of the invention as defined and limited only by the following claims.

What is claimed is:

1. A process for producing a final continuous multifilament yarn comprising heating a draw-textured first multifilament yarn end and mutually interlacing said thus heated draw-textured first multifilament yarn end and a drawn flat second multifilament yarn end.

2. A process for producing a continuous multifilament yarn comprising:

heating a first continuous multifilament yarn end;
drawing the thus heated first yarn end;
cooling the thus drawn first yarn end;
friction-texturing the thus cooled first yarn end;
reheating the thus textured first yarn end to thereby form a heated draw-textured first yarn end;
combining the thus heated draw-textured first yarn end and a drawn flat second continuous multifilament yarn end together; and
mutually entangling the thus combined first and second yarn ends so as to produce a final continuous multifilament yarn.

3. A process in accordance with claim 2 wherein said entangling step includes feeding said combined yarn ends through an air jet entanglement zone so as to interlace at least a portion of the filaments of said first yarn end among at least a portion of the filaments of said second yarn end.

4. A process in accordance with claim 2 wherein said entangling step includes feeding said combined yarn ends through an air jet entanglement zone at different linear speeds, said first yarn end being fed at a linear speed greater than the linear speed of said second yarn end, so as to interlace at least a portion of the filaments of said first yarn end among at least a portion of the filaments of said second yarn end.

5. A process in accordance with claim 2 wherein said flat second yarn end is drawn simultaneously with the draw-texturing of said first yarn end.

6. A process in accordance with claim 5 wherein the drawing of said second yarn end includes the steps of:

heating a second yarn end;
drawing the thus heated second yarn end; and
cooling the thus drawn second yarn end so as to form said drawn flat second yarn end.

7. A process in accordance with claim 6 wherein said entangling step includes feeding said combined first and second yarn ends through an air jet entanglement zone so as to interlace at least a portion of the filaments of said draw-textured first yarn end among at least a portion of the filaments of said drawn flat second yarn end.

8. A process in accordance with claim 7 wherein said draw-textured first yarn end is fed to said air jet entanglement zone at a linear speed greater than the linear speed at which said drawn flat second yarn end is fed to said air jet entanglement zone.

9. A process in accordance with claim 2 or claim 5 wherein said first and second yarn ends are each formed of melt-spinnable polymeric material.

10. A process in accordance with claim 2 or claim 5 wherein said first and second yarn ends are each formed of polyethylene terephthalate.

11. A process in accordance with claim 2 or claim 5 comprising the additional step of packaging said final continuous multifilament yarn.

12. A continuous multifilament yarn produced in accordance with claim 1 or claim 2 whereby said continuous multifilament yarn exhibits the effective appearance of a yarn spun from staple fibers and is at least substantially free from stretch.

13. A yarn in accordance with claim 12 wherein said first and second yarn ends are formed of melt-spinnable polymeric material.

14. A yarn in accordance with claim 12 wherein said first and second yarn ends are formed of the same melt-spinnable polymeric material.

15. A yarn in accordance with claim 12 wherein said first and second yarn ends are formed of melt-spinnable polymeric material selected from the group consisting of polyesters, polyamides, polyolefins and mixtures of any two or more thereof.

16. A yarn in accordance with claim 12 wherein said first and second yarn ends are formed of polyethylene terephthalate.

17. A textile fabric comprising a plurality of yarns, at least one of said yarns being produced in accordance with claim 1 or claim 2 and exhibiting the effective appearance of a yarn spun from staple fibers and being at least substantially free from stretch, and said fabric exhibiting a spun-like appearance.

18. A fabric in accordance with claim 17 wherein said first and second yarn ends are formed of melt-spinnable polymeric material.

19. A fabric in accordance with claim 17 wherein said first and second yarn ends are formed of the same melt-spinnable polymeric material.

20. A fabric in accordance with claim 17 wherein said first and second yarn ends are formed of melt-spinnable polymeric material selected from the group consisting of polyesters, polyamides, polyolefins and mixtures of any two or more thereof.

21. A fabric in accordance with claim 17 wherein said first and second yarn ends are formed of polyethylene terephthalate.

22. A textile fabric comprising a plurality of yarns wherein each of said plurality of yarns is produced in accordance with claim 1 or claim 2 and exhibits the effective appearance of a yarn spun from staple fibers and is at least substantially free from stretch, and said fabric exhibits a spun-like appearance.

* * * * *